US006359425B1

(12) United States Patent
Manolescu

(10) Patent No.: US 6,359,425 B1
(45) Date of Patent: Mar. 19, 2002

(54) CURRENT REGULATOR WITH LOW VOLTAGE DETECTION CAPABILITY

(75) Inventor: Mihai C. Manolescu, San Jose, CA (US)

(73) Assignee: Zilog, Inc., Campbell, CA (US)

( * ) Notice: Subject to any disclaimer, the term of this patent is extended or adjusted under 35 U.S.C. 154(b) by 0 days.

(21) Appl. No.: 09/460,442

(22) Filed: Dec. 13, 1999

(51) Int. Cl.[7] ..... G05F 1/573; G05F 3/16
(52) U.S. Cl. ..... 323/277; 323/315; 327/539
(58) Field of Search ..... 323/277, 313, 323/315, 316; 327/538, 539, 540

(56) References Cited

U.S. PATENT DOCUMENTS

| | | | | | |
|---|---|---|---|---|---|
| 5,637,992 | A | * | 6/1997 | Edwards | 323/315 |
| 5,847,556 | A | * | 12/1998 | Kothandaraman et al. | 323/315 |
| 6,018,235 | A | * | 1/2000 | Mikuni | 323/313 |
| 6,150,872 | A | * | 11/2000 | McNeill et al. | 323/313 |
| 6,175,265 | B1 | * | 1/2001 | Ueno | 327/540 |
| 6,198,266 | B1 | * | 3/2001 | Mercer | 323/316 |

* cited by examiner

*Primary Examiner*—Bao Q. Vu
(74) *Attorney, Agent, or Firm*—Skjerven Morrill MacPherson LLP

(57) ABSTRACT

A circuit for regulating a current provided by a power supply to drive a load in response to an input signal, is provided. The circuit contains a current source that has a specified current value and is coupled to the power supply. In addition, the circuit also comprises a controller that generates a reference voltage and is coupled to the current source. Furthermore, the circuit also includes a comparator that compares the reference voltage and a voltage at a node. To this node, controller is coupled. In addition, the load is coupled between the node and the power supply. In response to the input signal, the controller regulates the current to drive the load. This current has a first current-value that is proportional to the specified current value of the current source when the voltage at the node is greater than the reference voltage and a second current value that is based on the power supply when the voltage at the node is less than the reference voltage. Alternatively, this circuit may be modified so as to detect when [1] the power supply is low, [2] the load has been dislodged or [3] both.

38 Claims, 5 Drawing Sheets

CURRENT REGULATOR WITH LOW VOLTAGE DETECTION CAPABILITY

FIELD OF THE INVENTION

The present invention relates to current regulators. More specifically, the present invention relates to current regulator having low voltage detection capability.

BACKGROUND OF THE INVENTION

Electronic devices such as televisions and digital video disc players have become standard household accessories. These devices may be controlled directly or indirectly. For example, one may adjust the volume from a television by directly pressing on the "Volume+" button of the television. Alternatively, one may use the remote controller that comes with such television to indirectly adjust the volume. To do so, one presses on the "Volume+" button of the remote controller. In response, the remote controller generates an optical radiation signal and transmits such signal to the television. More specifically, a light emitting diode (LED) of the remote controller emits such signal so as to instruct the television to increase its volume. Within such controller, two AAA batteries may be installed to provide electric energy so as to produce a current to drive the LED.

Therefore, in applications in which a power supply provides a current to drive a load, it is desirable to prolong the life of the power supply. In addition, it is also desirable to detect when the electric energy of the power supply is low and thereby provides a signal indicating such status of the power supply so as to alert a user or operator. Furthermore, it is also desirable to detect whether the load has been dislodged so that corrective action can be taken.

SUMMARY OF THE INVENTION

According to one aspect of the present invention, a circuit for regulating a current provided by a power supply to drive a load in response to an input signal, is provided. The circuit contains a current source that has a specified current value and is coupled to the power supply. In addition, the circuit also comprises a controller that generates a reference voltage and is coupled to the current source. Furthermore, the circuit also includes a comparator that compares the reference voltage and a voltage at a node. To this node, controller is coupled. In addition, the load is coupled between the node and the power supply. In response to the input signal, the controller provides the current to drive the load. This current has a first current value that is proportional to the specified current value of the current source when the voltage at the node is greater than the reference voltage and a second current value that is based on the power supply when the voltage at the node is less than the reference voltage. Alternatively, this circuit may be modified so as to detect when [1] the power supply is low, [2] the load has been dislodged or [3] both.

According to a second aspect of the present invention, a method of regulating a current provided by a power supply to drive a load in response to an input signal, is provided. First, a current source having a specified current value is provided. Second, a reference voltage is provided. Third, comparing the reference voltage and a voltage at a node. With respect to this node, the load is coupled between the power supply and such node. Fourth, the current to drive the load is outputted in response to the input signal. This current has a first current value that is proportional to the specified current value of the current source when the voltage at the node is greater than the reference voltage. When the voltage at the node is less than the reference voltage, the current has a second current value that is based on the power supply.

These and other features and advantages of the present invention will be apparent from the figures as fully explained in the Detailed Description of the Preferred Embodiments.

BRIEF DESCRIPTION OF THE DRAWINGS

Other objects and features of the present invention and many of the attendant advantages of the present invention will be readily appreciated and become better understood by reference to the detailed description when considered in connection with the accompany drawings in which like reference numerals designate like parts throughout the figures thereof and wherein.

DETAILED DESCRIPTION OF THE PREFERRED EMBODIMENTS

Figure 1:
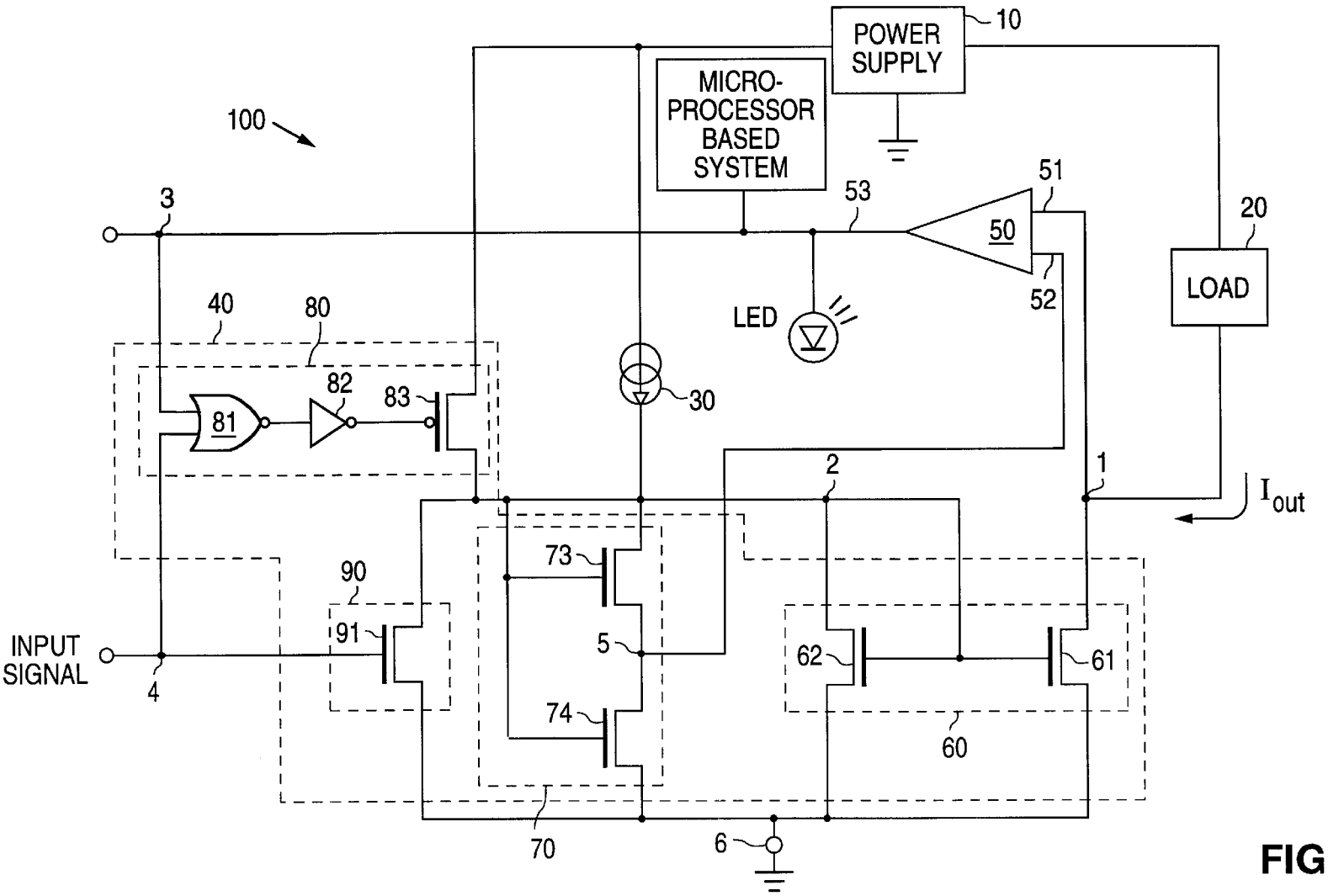
FIG. 1 illustrates a first preferred embodiment present invention. This first preferred embodiment is a circuit for regulating a current provided by a power supply to drive a load in response to an input signal.

FIG. 1 illustrates a first preferred embodiment present invention. This first preferred embodiment is a circuit 100. The circuit 100 regulates a current $I_{out}$ provided by a power supply 10 to drive a load 20 in response to an input signal. As shown in FIG. 1, the load 20 is coupled between the power supply 10 and a first node 1 and the power supply is grounded.

In order to regulate the current $I_{out}$, the circuit 100 comprises a current source 30 that is coupled between to the power supply 10 and a second node 2. In addition, the circuit 100 also contains-a controller 40 that is coupled to the first node 1, the second node 2, a third node 3, a fourth node 4, a reference node 6 and the power supply 10. The controller 40 generates a reference voltage at a fifth node 5 (hereinafter "the voltage $V_{REF}$"). Furthermore, the circuit 100 also includes a comparator 50 that has first and second input terminals 51, 52 and an output terminal 53. The first input terminal 51 is coupled to the first node, the second terminal 52 is coupled to the controller 40 at the fifth node 5 so as to receive the voltage $V_{REF}$, and the output terminal 53 is coupled to the third node 3. Functionally, the comparator 50 compares the voltage $V_{REF}$ and a voltage at the first node 1 (hereinafter "the voltage $V_{NI}$").

The controller 40 is now explained in detail. The controller 40 comprises a current driver 60, a reference voltage generator 70, a feedback circuit 80, and a switching circuit 90. With respect to the current driver 60, preferably it is a current mirror having field effect transistors 61, 62. The transistor 61 is coupled between the first node 1 and the reference node 6, and the transistor 62 is coupled between the second node 2 and the reference node 6. Both of their gate electrodes are coupled to the second node 2. Preferably, both of the transistors 61, 62 are N-channel metal-oxide semiconductors (NMOS) and the reference node 6 is grounded.

With respect to the reference voltage generator 70 of the controller 40, it preferably includes field effect transistors 73, 74. The transistor 73 is coupled between the second node 2 and the fifth node 5, and the transistor 74 is coupled between the fifth node 5 and the reference node 6. Both of their gate electrodes are coupled to the second node 2. Preferably, both the transistors 73, 74 are NMOS's.

With respect to the feedback circuit 80 of the controller 40, it preferably includes a NOR gate 81, an inverter 82, and a field effect transistor 83. The NOR gate has input terminals that are coupled to the third and fourth nodes 3, 4 and an output terminal that is coupled to an input terminal of the inverter 82. The inverter has an output terminal that is coupled to a gate electrode of the field effect transistor 83. The transistor 83 is coupled between the power supply 10 and the second node 2. Preferably, the transistor 83 is a P-channel metal-oxide semiconductor (PMOS).

With respect to the switching circuit 90, it preferably includes a field effect transistor 91 that is coupled between the second and reference nodes 2, 6. The transistor 91 has a gate electrode that is coupled to the fourth node 4 so as to receive the input signal.

The input signal has first and second logic states. The first logic state indicates that it is desirable to drive the load 20, and the second logic state indicates that it is not desirable to drive the load 20.

The operation of the circuit 100 is now explained based on the following assumptions. First, the first logic state of the input signal is a low logic state and the second logic state is a high logic state. Second, the transistors 61, 62, 73, 74 and 91 are NMOS's. Third, the transistor 83 is a PMOS. And fourth, the power supply, such as a battery source, is initially full of electric energy.

Figure 2:
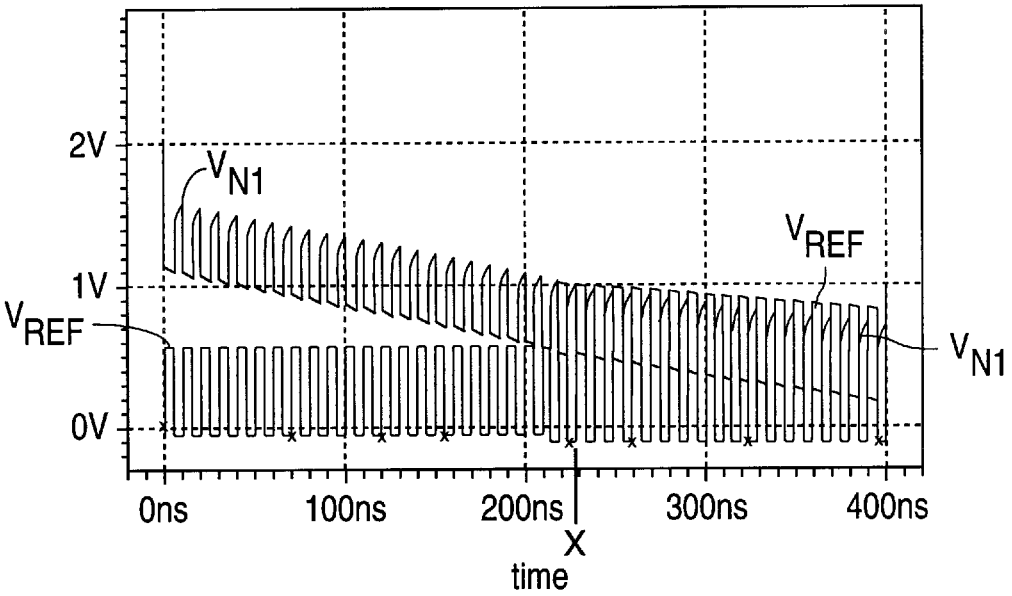
FIG. 2 is a graph of voltages $V_{NI}$ and $V_{REF}$ that are further explained below.

If it is desirable to drive the load, the low logic input signal is applied to the fourth node 4. In response, the transistor 91 is off. Similarly, transistor 83 is also off because there is a high logic signal being applied to its gate electrode as further explained by the rest of this paragraph. When the power supply 10 is full of electric energy, the voltage $V_{NI}$ is higher than the voltage $V_{REF}$ as illustrated by FIG. 2. As a result, the comparator 50 outputs a high logic signal. The high logic output signal of the comparator 50 and the low logic input signal applied to the fourth node 4 are inputted into the NOR gate 81. In response, NOR gate 81 outputs a low logic signal to the input terminal of the inverter 82. Thereby, the inverter 82 outputs a high logic output signal to the gate electrode of the transistor 83. Thus, transistor 83 is off.

When the transistor 83 is off, the current source 30 is solely responsible for regulating the current $I_{out}$. As previously indicated, the current source 30 has a specified current value. This specified current value is predetermined based geometric dimensions of the transistors 61, 62 and 74 so that the amount of amperage used to drive the load 20 is controlled to [1] conserve electric energy, [2] prolong the life of the power supply such as a battery, or [3] both. In the preferred embodiment, the width-to-length ratio (W/L) of the transistors 61, 62 and 74 is 10/2.5 while the W/L of the transistor 73 is 10/50. With these transistors dimensions, a small portion of the current source 30 goes through the reference voltage generator 70 while a large portion of the current source 30 goes through the transistor 62. Thus, the current $I_{out}$ has a current value that is [1] equivalent to the large amount of amperage going through the transistor 62 due to the arrangement of the transistors 61, 62 as a current mirror and [2] proportional to the specified current value of the current source 30.

After each time the current $I_{out}$ is provided to drive the load 20, the electric energy of the power supply 10 is further reduced. Eventually at a time X as indicated in FIG. 2, the voltage $V_{NI}$ will be less than the voltage $V_{REF}$. When this occurs, the output of the comparator 50 flips from the high logic output signal to a low logic output signal. Thus, the low logic output signal of the comparator 50 and the low logic input signal applied to the fourth node 4 are inputted into the NOR gate 81 that thereby outputs a high logic signal to the input terminal of the inverter 82. In response, the inverter 82 outputs a low logic signal to the gate electrode of the transistor 83. As a result, the transistor 83 is on and the power supply 10 appears at the second node 2.

Figure 3:
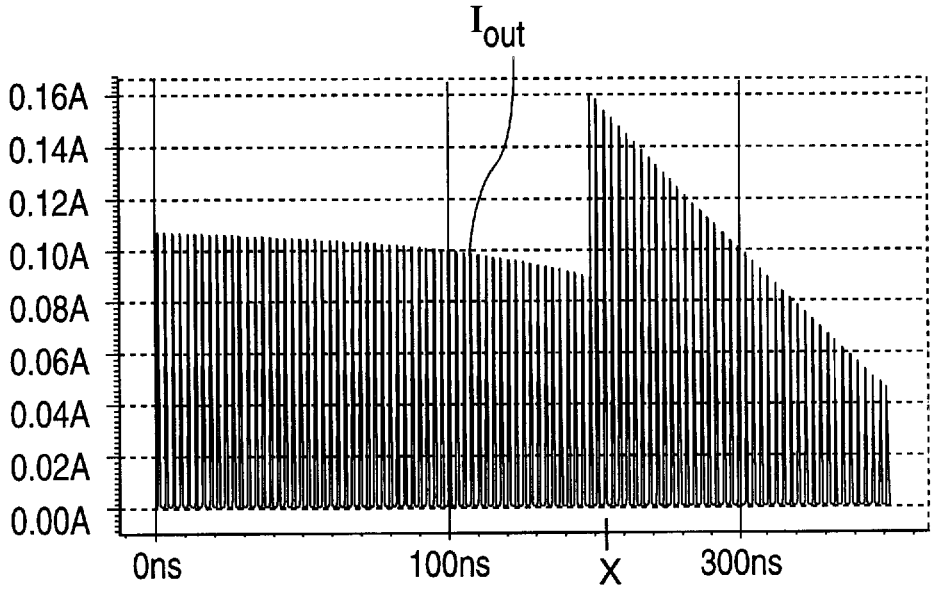
FIG. 3 is a graph of the current that drives the load.

When the power supply 10 appears at the second node 2 after the comparator's output had flipped, the current that is now going through the transistor 62, which is also the current $I_{out}$ as explained above, is much higher than the current that previously went through the transistor 62. FIG. 3 illustrates this phenomenon by providing a graph of the current $I_{out}$ with respect to time. Note that the current $I_{out}$ increases substantially at the time X even though at which time the voltage $V_{NI}$ is less than the voltage $V_{REF}$. In addition, note that the current $I_{out}$ now has a current value that is based on the power supply 10, not based on the current source 30. In effect, the circuit 100 of the present invention boosts the current $I_{out}$ at the time when the electric energy of the power supply 10 is almost depleted so as to maximize the life or use of the power supply 10 and also to provide additional time during which a user can replace the drained power supply 10 as further explained below.

In addition to its current boosting capability, the circuit 100 also provides the following additional features. When the input signal indicates that it is desirable to drive the load, the comparator 50 outputs either a low logic output signal indicating that the voltage $V_{REF}$ is higher than the voltage $V_{NI}$ or a high logic output signal indicating that the voltage $V_{REF}$ is lower than the voltage $V_{NI}$. By coupling the output terminal 53 of the comparator 50 to, e.g., a light emitting diode (LED), the LED may be set to be on in response to the low logic output signal of the comparator 50 and to be off in response to the high logic output signal of the comparator 50. When the LED is off, it may be interpreted that the load 20 has been properly driven in response to the input signal indicating that it is desirable to drive the load 20. When the LED is on and if the power supply 10 is a battery source, it may be interpreted that either [1] the electric energy of the power supply 10 has dropped below an undesirable level and thus the battery source should be replaced with a new one or [2] the load 20 has been dislodged and thus corrective action must taken. When the LED is on and if the power supply 10 is a constant power supply such as a power outlet, it may be interpreted that the load 20 has been dislodged and thus corrective action must be taken. Accordingly, a microprocessor-based system can also be coupled to the output terminal 53 of the comparator 50 so as to display and alert the system operator of the above possibilities.

Figure 4:
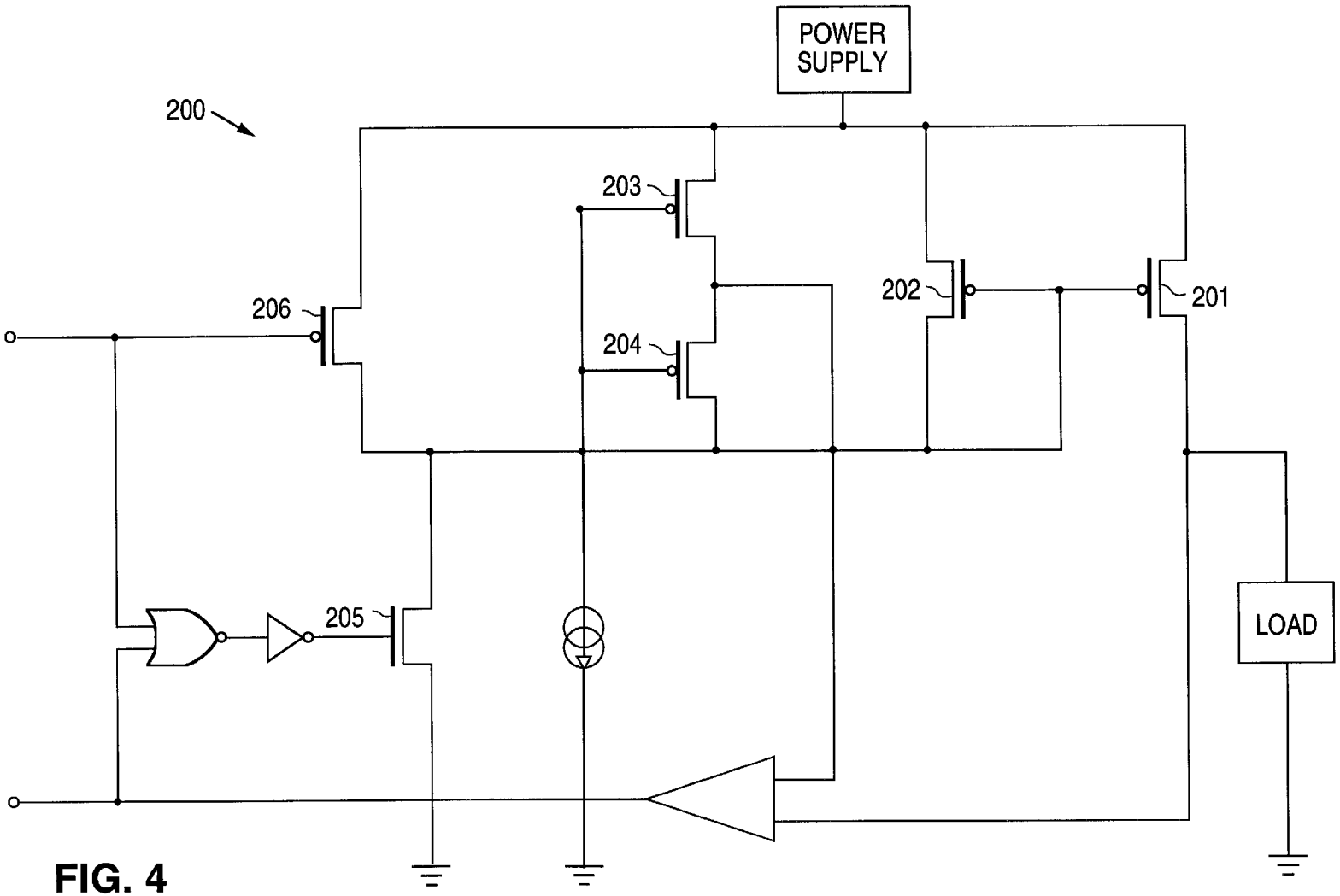
FIG. 4 illustrates a second preferred embodiment of the present invention. This second preferred embodiment is a complement of the first preferred embodiment.

FIG. 4 illustrates a second preferred embodiment of the present invention. This second preferred embodiment is a circuit 200. The operation of the circuit 200 is essentially similar to the operation of the circuit 100 and thus need not be explained. The reason is that the circuit 200 is a complement of the circuit 100. More specifically, the circuit 100 may be labeled as a "current sink" regulator and the circuit 200 may be labeled as a "current source" regulator. Note that the transistors 61, 62, 73, 74 and 91 of the circuit 100 corresponds to the transistors 201–205 of the circuit 200 and thus, if the transistors 61, 62, 73, 74 and 91 are NMOS's, the transistors 201–205 should be PMOS's, and vice versa. Similarly, transistor 83 of the circuit 100 corresponds to a transistor 206 of the circuit 200 and thus, if the transistor 91 is a PMOS, the transistor 206 should be a NMOS, and vice versa.

Figure 5:
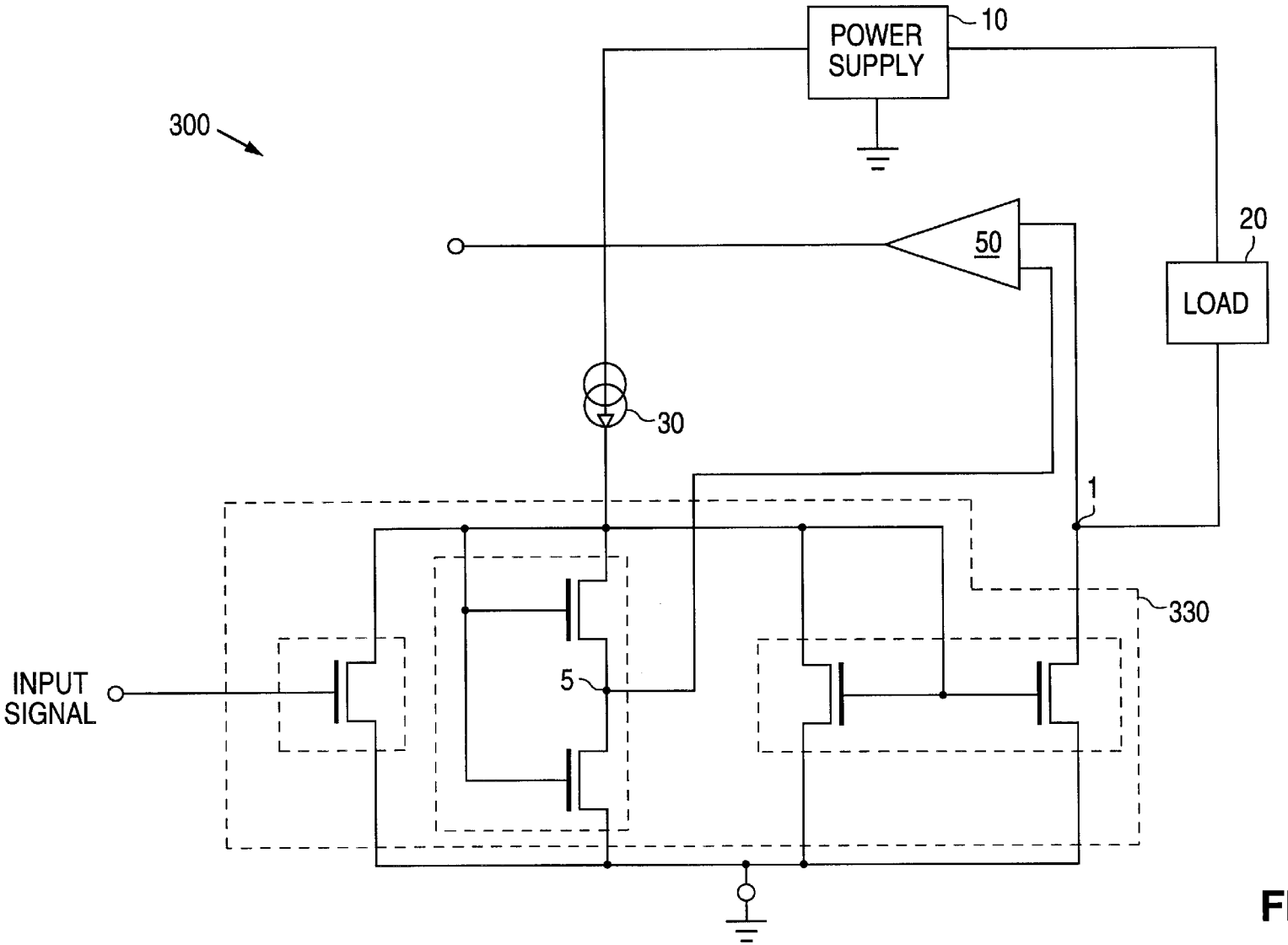
FIG. 5 illustrates a third preferred embodiment of the present invention. This third preferred embodiment is a circuit for detecting whether a load has been driven by a current provided by a power supply in response to an input signal.

FIG. 5 illustrates a third preferred embodiment of the present invention. This third preferred embodiment is a circuit 300 for detecting whether a load 20 has been driven by a current $I_{out}$ provided by a power supply 10 in response to an input signal. Note that a controller 330 of the circuit 300 does not have a feedback circuit. Functionally, the operation of the circuit 300 is similar to the operation of the circuit 100 and thus need not be explained in detail. However, note that the circuit 300 does not have the current boosting capability as described above with respect to the circuit 100. Thus, if the voltage $V_{NI}$, drops below the voltage $V_{REF}$, the power supply 10 does not have sufficient electric energy so as to provide the current to drive the load. In addition, when the input signal indicates that it is desirable to drive the load 20 and if the voltage $V_{NI}$, is less than the voltage $V_{REF}$, the LED is on so as to indicate that either [1] the load has not been driven because the electric energy of the power supply 10 has dropped below an undesirable level or [2] the load 20 has been dislodged. For both indications, corrective action should be taken.

Figure 6:
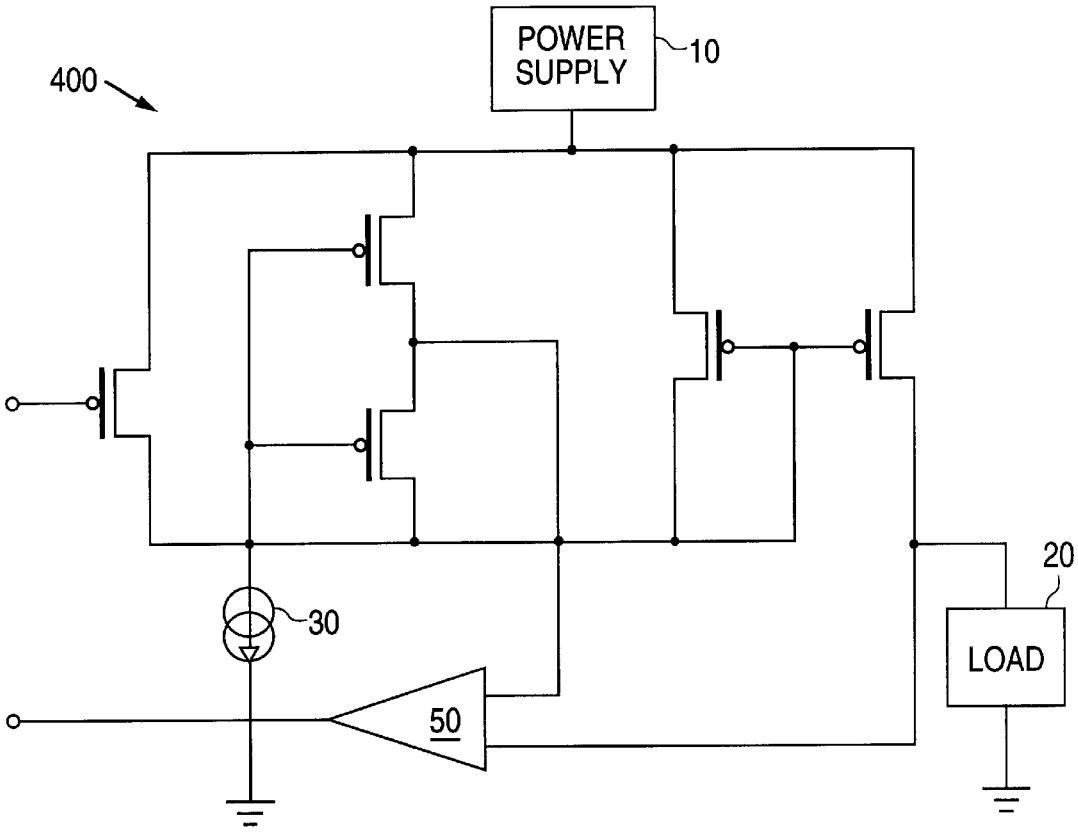
FIG. 6 illustrates a fourth preferred embodiment of the present invention. This fourth preferred embodiment is a complement of the third preferred embodiment.

FIG. 6 illustrates a fourth preferred embodiment of the present invention. This fourth preferred embodiment is a circuit 400. The operation of the circuit 400 is essentially similar to the operation of the circuit 300 and thus need not be explained because the circuit 400 is a complement of the circuit 300.

Figure 7:
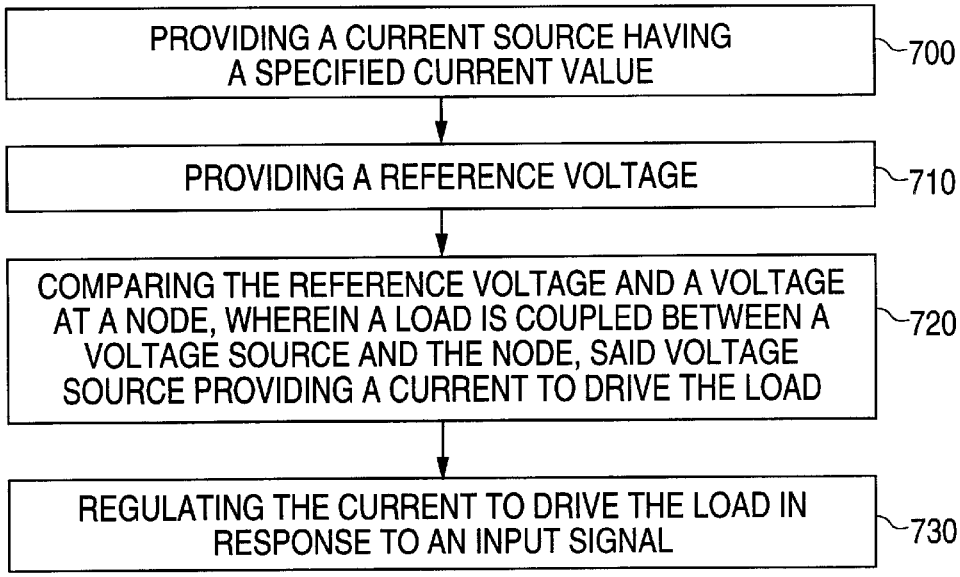
FIG. 7 illustrates steps of a method of regulating a current provided by a power supply to drive a load in response to an input signal.

FIG. 7 illustrates steps of a method of regulating a current provided by a power supply to drive a load in response to an input signal. In step 700, a current source having a specified current value is provided. Preferably, the current source is coupled to the power supply. In step 710, a reference voltage is provided. In step 720, the reference voltage and a voltage at a node, where the load is coupled between the power supply and such node. And finally in step 730, the current to drive is regulated in response to an input signal. The regulated current has a first current value that is proportional to the specified current value of the current source when the voltage at the node is greater than the reference voltage and a second current value that is based on the power supply when the voltage at the node is less than the reference voltage.

With the present invention has been described in conjunction with several alternative embodiments, these embodiments are offered by way of illustration rather than by way of limitation. Those skilled in the art will be enabled by this disclosure to make various modifications and alterations to the embodiments described without departing from the spirit and scope of the present invention. Accordingly, these modifications and alterations are deemed to lie within the spirit and scope of the present invention as specified by the appended claims.

I claim:

1. A circuit for regulating a current provided by a power supply to drive a load in response to an input signal, said load coupled between the power supply and a node, comprising:

a current source having a specified current value, said current source coupled to the power supply;

a controller generating a reference voltage, said controller coupled to the node and the current source; and a comparator for comparing a voltage at the node and the reference voltage, wherein the controller regulates the current to drive the load in response to the input signal, said current having a first current value that is proportional to the specified current value of the current source when the voltage at the node is greater than the reference voltage.

2. The circuit of claim 1, wherein the current has a second current value that is based on the power supply when the voltage at the node is less than the reference voltage.

3. The circuit of claim 1, wherein the controller includes a current mirror.

4. The circuit of claim 1, wherein the controller includes a reference voltage generator for generating the reference voltage.

5. The circuit of claim 1, wherein the controller includes a switching device to which the input signal is applied.

6. The circuit of claim 4, wherein the controller further comprises a current mirror that includes first and second field effect transistor, further wherein the reference voltage generator comprises third and fourth field effect transistors, and further wherein the specified current value of the current source is predetermined based on geometric dimensions of the first, second, and fourth field effect transistors.

7. The circuit of claim 1, wherein the input signal has first and second logic states, said first logic state indicating that it is desirable to drive the load and said second logic state indicating that it is not desirable to drive the load.

8. The circuit of claim 7, the comparator outputs a signal in response to the first logic state input signal, said signal having first and second logic states, said first logic state of the signal indicating that the reference voltage is lower than the voltage at the first node and said second logic state of the signal indicating that the reference voltage is higher than the voltage at the first node.

9. A circuit for regulating a current provided by a power supply to drive a load in response to an input signal, said load coupled between the power supply and a first node, comprising:

a current source coupled between the power supply and a second node, said current source having a specified current value;

a controller coupled to the first node, the second node, third and fourth nodes, a reference node and the power supply, said controller generating a reference voltage; and a comparator having first and second input terminals and an output terminal, said first input terminal coupled to the first node, said second terminal coupled to the controller so as to receive the reference voltage, and said output terminal coupled to the third node, wherein the controller regulates the current to drive the load in response to the input signal.

10. The circuit of claim 9, wherein the current has a first current value that is proportional to the specified current value of the current source when a voltage at the first node is greater than the reference voltage and a second current value that is based on the power supply when the voltage at the first node is less than the reference voltage.

11. The circuit of claim 9, wherein the reference node is a reference ground potential.

12. The circuit of claim 9, wherein the controller includes a current mirror that is coupled to the first, second and reference nodes.

13. The circuit of claim 9, wherein the controller includes first and second field effect transistors, said first field effect transistor coupled between the first and reference nodes and said second field effect transistor coupled between the second and reference nodes, and further wherein gate electrodes of the first and second field effect transistors are coupled to the second node.

14. The circuit of claim 9, wherein the controller includes a reference voltage generator for generating the reference voltage, said reference voltage generator coupled to the second node, the reference node, and the comparator.

15. The circuit of claim 14, wherein the reference voltage generator comprises third and fourth field effect transistors, said third field effect transistor coupled between the second node and a fifth node and said fourth field effect transistor coupled between the fifth and reference nodes, and further wherein the reference voltage generator generates the reference voltage at the fifth node.

16. The circuit of claim 9, wherein the controller includes a switching device coupled to the second, fourth and reference nodes, and further wherein the input signal is applied to the switching device via the fourth node.

17. The circuit of claim 16, wherein the switching device is a fifth field effect transistor coupled between the second, fourth and reference nodes, and further wherein a gate electrode of the fifth field effect transistor is coupled to the fourth node.

18. The circuit of claim 9, wherein the controller includes a feedback circuit coupled to the second, third and fourth nodes and the power supply, and further wherein the input signal is applied to the feedback circuit.

19. The circuit of claim 18, wherein the feedback circuit comprises:

a NOR gate having first and second input terminals and an output terminal, said first input terminal coupled to the third node and said second input terminal coupled to the fourth node to which the input signal is applied;

an inverter having input and output terminals, said input terminal of the inverter coupled to the output terminal of the NOR gate; and a sixth field effect transistor coupled between the power supply and the second node, and further wherein a gate electrode of the sixth field effect transistor is coupled to the output terminal of the inverter.

20. The circuit of claim 9, wherein the controller comprises:

a current driver comprising:

first and second field effect transistors, said first field effect transistor coupled between the first and reference nodes and said second field effect transistor coupled between the second and reference nodes, and further wherein gate electrodes of the first and second field effect transistors are coupled to the second node; and a reference voltage generator for generating the reference voltage, said reference voltage generator comprising:

third and fourth field effect transistors, said third field effect transistor coupled between the second node and a fifth node and said fourth field effect transistor coupled between the fifth and reference nodes.

21. The circuit of claim 20, wherein the specified current value of the current source is predetermined based on geometric dimensions of the first, second, and fourth field effect transistors.

22. The circuit of claim 9, wherein the input signal has first and second logic states, said first logic state indicating that it is desirable to drive the load and said second logic state indicating that it is not desirable to drive the load.

23. The circuit of claim 22, the comparator outputs a signal at its output terminal in response to the first logic state of the input signal, said signal having a first state indicating that the reference voltage is lower than the voltage at the first node and a second logic state indicating that the reference voltage is higher than the voltage at the first node.

24. The circuit of claim 23, wherein a light emitting diode is coupled to the third node so as to receive the signal, and further wherein the light emitting diode is off after receiving the first logic state of the signal and is on after receiving the second logic state of the signal.

25. The circuit of claim 23, wherein a microprocessor is coupled to the third node so as to receive the signal, said microprocessor providing an alert signal in response to the second logic state of the signal, said alert signal indicating that the power supply is low, the load has been dislodged or both.

26. A circuit for detecting whether a load has been driven by a current provided by a battery source in response to an input signal, said load coupled between the battery source and a node, comprising:

a current source coupled to the battery source, said current source having a specified value;

a controller coupled to the node and the current source, said controller generating a reference voltage; and a comparator having first and second input terminals and an output terminal, said first input terminal coupled to the node, said second terminal coupled to the controller so as to receive the reference voltage, wherein the comparator outputs a signal at the output terminal, said signal indicating whether the load has been driven.

27. The circuit of claim 26, wherein the signal has first and second logic states, said first logic state indicating that the load has been driven and said second logic state indicating that the load has not been driven, and further wherein the comparator outputs the first logic state signal when a voltage at the node is greater than the reference voltage and the second logic state signal when the voltage at the node is less than the reference voltage.

28. The circuit of claim 27, wherein the comparator provides the signal to a light emitting diode, and further wherein the light emitting diode is on after receiving the second logic state signal and is off after receiving the first logic state signal.

29. The circuit of claim 27, wherein the comparator provides the signal to a microprocessor, said microprocessor providing an alert signal in response to the second logic signal, said alert signal indicating that either the battery source is low, the load has been dislodged or both.

30. The circuit of claim 26, wherein the controller includes a current mirror.

31. The circuit of claim 26, wherein the controller includes a reference voltage generator for generating the reference voltage.

32. The circuit of claim 31, wherein the controller further comprises a current mirror that includes first and second field effect transistor, further wherein the reference voltage generator comprises third and fourth field effect transistors, and further wherein the specified current value of the current source is predetermined based on geometric dimensions of the first, second, and fourth field effect transistors.

33. The circuit of claim 26, wherein the controller includes a switching device to which the input signal is applied.

34. The circuit of claim 26, wherein the input signal has first and second logic states, said first logic state indicating that it is desirable to drive the load and said second logic state indicating that it is not desirable to drive the load.

35. A method of regulating a current provided by a power supply to drive a load in response to an input signal, said load coupled between the power supply and a node, comprising steps of:

providing a current source having a specified current value;

providing a reference voltage;

comparing the reference voltage and a voltage at the node; and regulating the current to drive the load in response to the input signal, said current having a first current value that is proportional to the specified current value of the current source when the voltage at the node is greater than the reference voltage.

36. The method of claim 35, wherein the current has a second current value that is based on the power supply when the voltage at the node is less that the referenced voltage.

37. The method of claim 35, wherein the step of providing the current source includes coupling the current source to the power supply.

38. The method of claim 35 further comprises a step of outputting a signal indicating whether the reference voltage is lower or higher than the voltage at the node.

* * * * *